United States Patent [19]

Bewley

[11] Patent Number: 4,980,945

[45] Date of Patent: Jan. 1, 1991

[54] SAFETY INTERLOCK DEVICE FOR A VACUUM CLEANER

[75] Inventor: Wilbur C. Bewley, Lexington, Ky.

[73] Assignee: Whirlpool Corporation, Benton Harbor, Mich.

[21] Appl. No.: 441,565

[22] Filed: Nov. 27, 1989

[51] Int. Cl.[5] ..... A47L 5/36

[52] U.S. Cl. ..... 15/339; 15/377; 15/410; 15/412

[58] Field of Search ..... 15/410, 377, 389, 391, 15/412, 339

[56] References Cited

U.S. PATENT DOCUMENTS

| | | | |
|---|---|---|---|
| 4,329,757 | 5/1982 | Ramstrom et al. . | |
| 4,516,289 | 5/1985 | Sumerau . | |
| 4,700,429 | 10/1987 | Martin et al. . | |
| 4,724,574 | 2/1988 | Bowerman et al. . | |
| 4,787,117 | 11/1988 | Westergren | 15/377 |

*Primary Examiner*—Timothy F. Simone
*Assistant Examiner*—P. Brinson
*Attorney, Agent, or Firm*—Wood, Phillips, Mason, Recktenwald & VanSanten

[57] ABSTRACT

A vacuum cleaner has a disconnectable handle and dirt tube assembly mounted to a floor nozzle. The assembly includes a wire harness connector which mates to a corresponding connector in the floor nozzle to provide power to the floor nozzle components. The connectors are each securely mounted in their respective components, so that when the handle assembly is connected to the floor nozzle, the electrical connection is automatically made. Access to the floor nozzle components is had by removal of the floor nozzle cover. The handle assembly, when installed, is located in spaced relationship from the floor nozzle, overlying an arcuate portion of the floor nozzle top in all but a horizontal position of the handle assembly. When the handle assembly is in a horizontal position, a body edge of the handle assembly overlies projections on the nozzle cover. As a result, in any handle position, the nozzle top may not be removed until the handle assembly is removed from the floor nozzle, thereby disconnecting power to the floor nozzle.

16 Claims, 2 Drawing Sheets

SAFETY INTERLOCK DEVICE FOR A VACUUM CLEANER

FIELD OF THE INVENTION

This invention relates to vacuum cleaners and, more particularly, to a safety interlock device for a vacuum cleaner.

BACKGROUND OF THE INVENTION

Certain types of vacuum cleaners include a floor engaging portion in the form of a wheeled nozzle. One such type is an upright vacuum cleaner which includes a floor nozzle having a rotatable brush driven by a motor. The brush is linked to the motor using a belt. Certain canister vacuum cleaners include a power nozzle also have a motor driven rotatable brush.

In any such known vacuum cleaners, it is often necessary to obtain access to the floor nozzle components. For example, it is advantageous that a user frequently clean the brush, which often requires removal. Similarly, the belt can become worn and damaged over time, and might even break.

It is known to provide vacuum cleaners having access to the floor nozzle components, either through an access panel on the bottom of the floor nozzle, or by removal of a nozzle top cover. Once access is obtained, these components are within reach of the user, particularly one's fingers. If the vacuum is inadvertently left connected to power and an on/off switch is turned on, then the high speed rotating components could cause serious injury. Further, if the user inadvertently touches an electrical conductor, either directly or with a tool, an electrical shock could be felt.

Martin et al. U.S. Pat. No. 4,700,429, assigned to the assignee of the present invention, discloses a quick release wand for a canister vacuum cleaner. Removal of the wand disengages power from the floor nozzle to prevent electrical shock or energization of the floor nozzle components, however, access to floor nozzle components is possible while the wand is connected.

Ramstrom et al. U.S. Pat. No. 4,329,757 discloses a vacuum cleaner floor nozzle including a safety switch which prevents energization of the nozzle motor if a head lamp shroud is removed. However, even with actuation of the safety switch, the floor nozzle is not positively disconnected from the source of power. Resultantly, electrical shock could result. Moreover, a user could jury-rig such a nozzle so that it could become energized with the lamp shroud open, resulting in potential injury.

The present invention is intended to overcome one or more of the problems discussed above, in a novel and simple manner.

SUMMARY OF THE INVENTION

In accordance with the invention, a safety interlock device for a vacuum cleaner floor nozzle permits user access to floor nozzle components while preventing the user from being shocked or injured due to user contact with exposed or moving components.

In addition, the invention contemplates a reliable safety interlock device at minimum expense for both parts and assembly.

Moreover, the vacuum cleaner according to the invention provides a safety interlock device that is easy to use, yet discourages tampering and attempts to defeat it.

Broadly, there is disclosed herein a vacuum cleaner including a handle and a floor engaging portion coupled to the handle and having a base mounting an electrical motor and a rotatable brush driven by the motor. A cover is removably mounted to the base and overlies the motor and the brush. A plurality of electrical conductors connectable to a source of power extend from the handle to the motor. Means are operatively associated with the floor engaging portion for disconnecting the motor from the source of power incident to removing the cover from the base.

It is a feature of the invention that the disconnecting means comprises a plug and a socket.

It is a further feature of the invention that the disconnecting means comprises means for preventing removal of the cover unless the handle is uncoupled from the floor engaging portion.

It is an additional feature of the invention that the disconnecting means comprises a removable wand disposed between the handle and the floor engaging portion.

Specifically, there is disclosed herein a vacuum cleaner having a disconnectable handle and dirt tube assembly mounted to a floor nozzle. The assembly includes a wire harness connector which mates to a corresponding connector in the floor nozzle to provide power to the floor nozzle components. The connectors are each securely mounted in their respective components, so that when the handle assembly is connected to the floor nozzle, the electrical connection is automatically made.

Access to the floor nozzle components is had by removal of the floor nozzle cover. To provide the desired safety function, the handle assembly, when installed, is located in spaced relationship from the floor nozzle, overlying an arcuate portion of the floor nozzle top in all but a horizontal position of the handle assembly. When the handle assembly is in a horizontal position, a body edge of the handle assembly overlies projections on the nozzle cover. The floor nozzle cover is removable by releasing two tabs on the rear of the nozzle cover and rotating the cover upwardly and forwardly. As a result, in any handle position, the nozzle top may not be removed until the handle assembly is removed from the floor nozzle by depressing two tabs on the handle assembly, thereby disconnecting power to the floor nozzle.

More specifically, the floor nozzle components include a rotatable brush and a motor. A belt links the brush to the motor. In order to remove the brush for cleaning, or the belt for changing, the nozzle cover must first be removed, which requires the disconnection of power, as discussed above.

Further features and advantages of the invention will readily be apparent from the specification and from the drawings.

DESCRIPTION OF THE INVENTION

Figure 1:
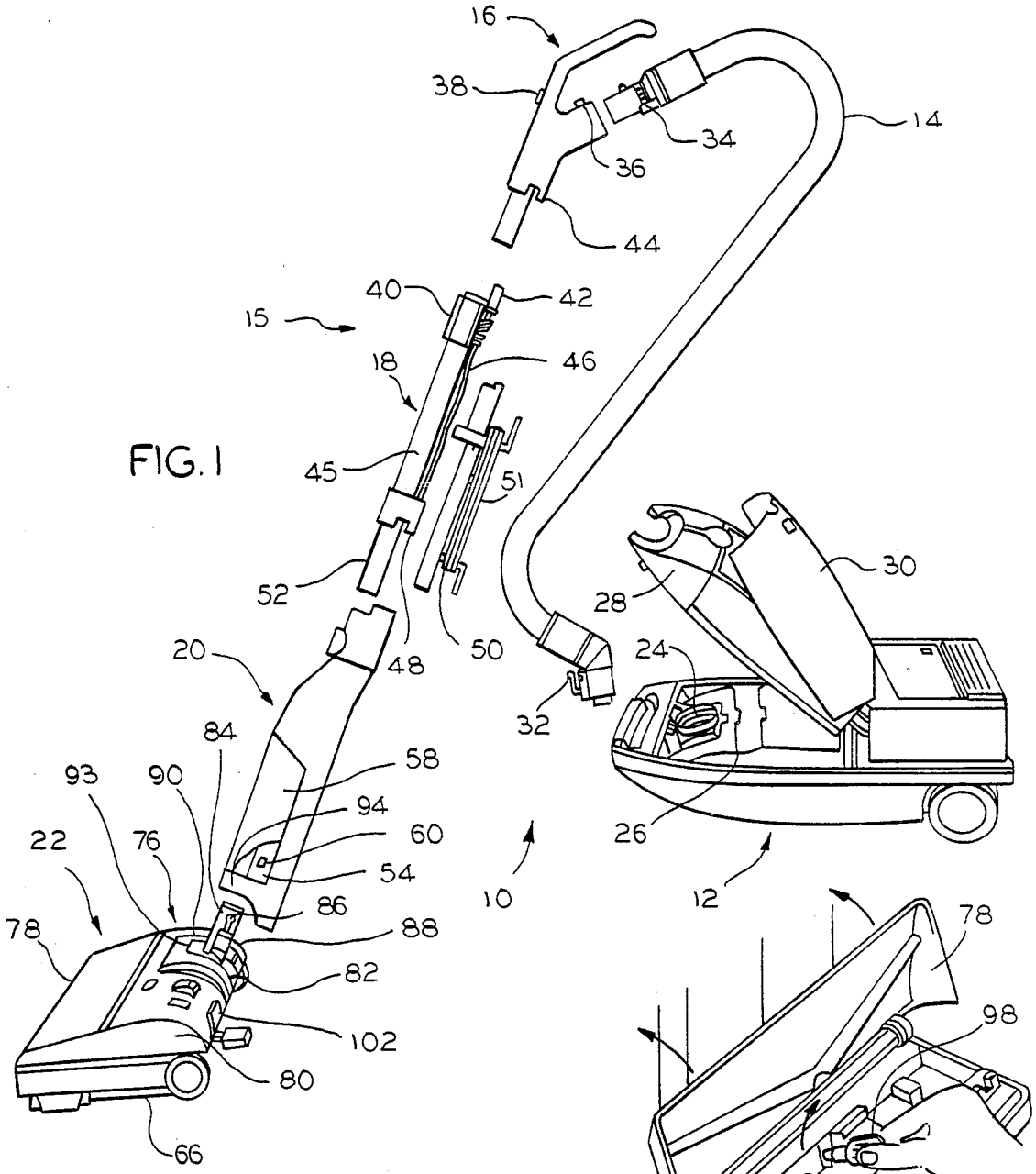
FIG. 1 is a partially exploded perspective view of a vacuum cleaner including the safety interlock according to the invention.

Referring to FIG. 1, a vacuum cleaner 10 including the safety interlock according to the invention is illustrated. The vacuum cleaner 10 comprises a canister type vacuum cleaner Although the description herein relates to such a vacuum cleaner, the safety interlock according to the invention could be used in connection with other types of vacuum cleaners as is obvious to those skilled in the art.

The vacuum cleaner 10 comprises a plurality of assemblies which come partially preassembled, and can be readily assembled by a user thereof. The vacuum cleaner can then be easily broken down, if necessary, for storage or shipment.

The vacuum cleaner 10 includes a canister 12 connected through a hose 14 to a handle assembly 15. The handle assembly 15 includes a handle 16 connected through a wand assembly 18 to a dust cup assembly 20. The dust cup assembly 20 is connected to a floor engaging nozzle 22.

Although not shown, the canister 12 includes a motor which develops vacuum pressure at an opening 24 to draw dust and debris into a dust bag 26, as is well known. The canister includes a canister hood 28 for mounting attachments, and a cover 30 for enclosing such attachments.

The hose 14 includes a first coupling element 32 at one end for attaching to the canister 12 at the vacuum opening 24. At its opposite end, the hose 14 includes a second coupling element 34 having a suction control for connection to a hose quick release element 36 on the handle 16. The handle 16 also includes an on/off switch 38 used to energize and deenergize the vacuum cleaner. To effect energization of the motor in the canister 12, the on/off switch 38 is connected to the canister 12 utilizing electrical conductors helically wound in the cover for the hose 14, and connected through suitable connector elements at the hose coupling members 32 and 34.

The wand assembly 18 includes a handle quick release structure 40 for connecting to the handle 16. The wand quick release structure 40 includes an electrical connector 42 for mating with a corresponding electrical connector 44 on the handle 16. The wand assembly 18 also includes a tube 45 which carries electrical conductors 46 from the connector 42 to a second connector 48. A cord wrap assembly 50 is provided for securing to the wand assembly to provide storage for an electrical power cord 51.

Figure 5:
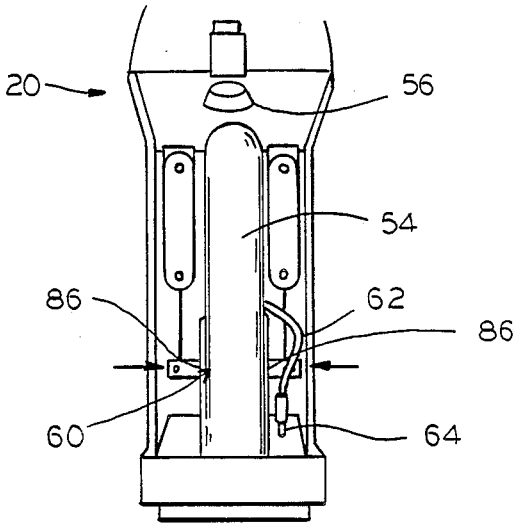
FIG. 5 is a partial perspective view illustrating removal of the wand assembly from the floor nozzle.
Figure 6:
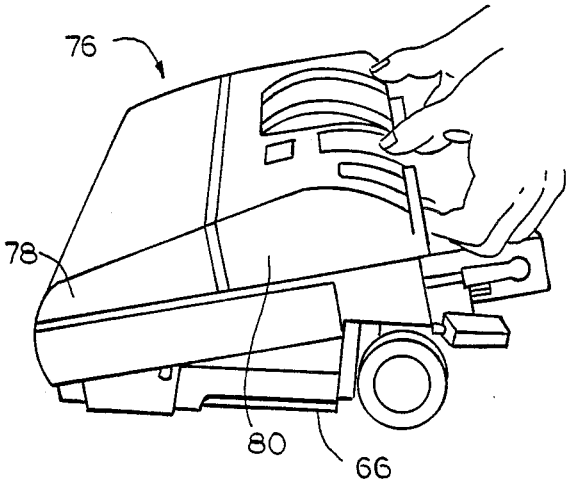
FIG. 6 is a partial perspective view illustrating removal of the floor nozzle cover.

A lower end 52 of the tube 45 is telescopically received in the dust cup assembly 20. The dust cup assembly 20 includes a longitudinally extending tube, part of which is illustrated at 54, see also FIG. 5. The tube 54 is also connected through an opening 56 which opens into a removable dust cup 58. Specifically, the vacuum cleaner can be used in light duty applications without the canister 12 whereby dust and debris can be collected in the dust cup 58.

The dust cup assembly 20 is provided with a pair of openings 60, one each on opposite sides of the tube 54. Also, a pair of conductors 62 are provided for connection to the wand assembly connector 48 and terminating in a socket 64.

Figure 3:
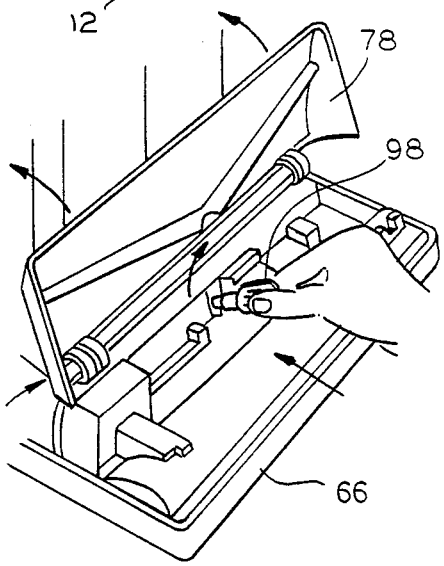
FIG. 3 is a partial perspective view illustrating removal of head lamp.
Figure 4:
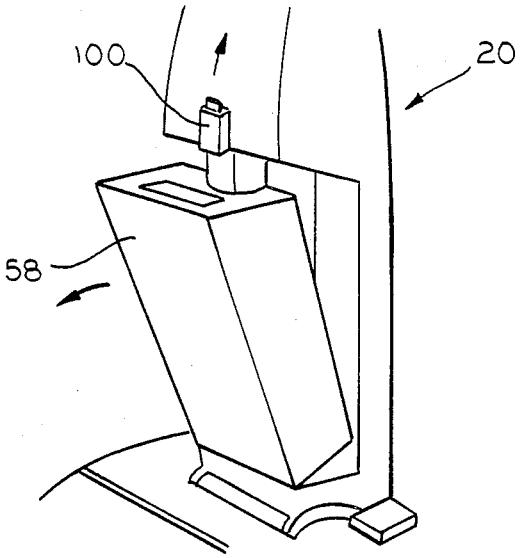
FIG. 4 is a partial perspective view illustrating removal of a dust cup.
Figure 7:
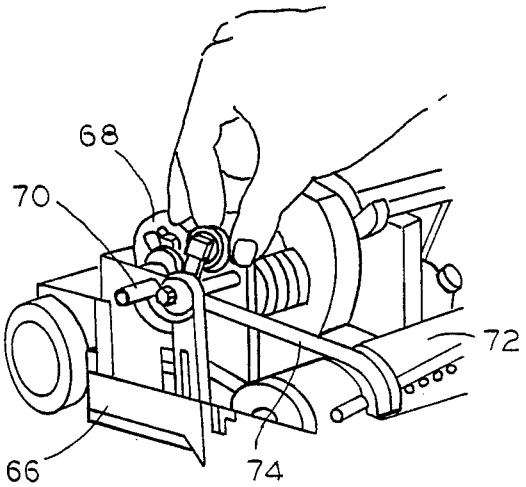
FIG. 7 is a partial perspective view illustrating the floor nozzle components.

The floor nozzle 22, see also FIGS. 3 and 7, includes a base 66 mounting a motor 68, having a shaft 70, and a rotatable brush 72. The motor shaft 70 is connected to the rotatable brush 72 using a conventional belt 74. A two piece cover assembly 76 is pivotally mounted to the base 66 and overlies the motor and rotatable brush. Specifically, the cover assembly 76 includes a light cover 78 pivotally mounted to a nozzle top cover 80.

The floor nozzle 22 includes a swivel coupler 82 having a rectangular outwardly extending tube 84 for mating with the tube 54 on the dust cup assembly 20. A pair of flexible tabs 86 are provided at each side of the tube 84 for engaging the apertures 60 of the dust cup assembly tube 54. Also, a plug 88 is integrally mounted to one side of the tube 84 for mating with the dust cup assembly socket 64 when installed.

When the respective components discussed above are assembled in the usual manner, the vacuum at the canister opening 24 is present at the floor nozzle tube 84 as is conventional. Consequently, dirt and debris on the floor is drawn up into the canister dust bag 26. Additionally, rotation of the brush 72 causes agitation which aids in the floor cleaning operation.

As discussed above, the vacuum cleaner 10 can be used in light duty applications without the canister 12. In such instances, the hose 14 is removed from the handle 16, and a cord assembly is inserted which closes off the opening in the handle 16, but yet provides power directly to the handle 16. Resultantly, when the on/off switch 38 is actuated, the motor 68 is driven and action of the brush 72 transfers the dust and debris up into the dust cup 58.

Figure 2:
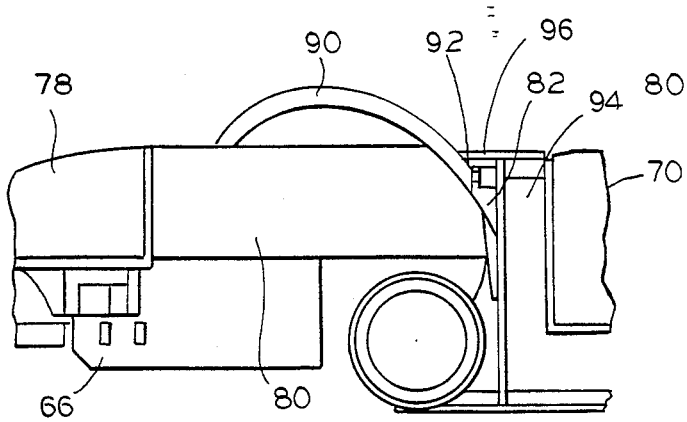
FIG. 2 is a partial side view of the floor nozzle and wand assembly of FIG. 1, showing the wand assembly in the horizontal position.

With references also to FIG. 2, the floor nozzle top cover 80 includes a central arcuate portion 90 having an opening 93 through which the swivel coupler 82 pivots. An outwardly extending projection 92 is provided on the arcuate portion 90 on either side of the slot 93. The dust cup assembly 20 includes an enlarged base end 94 which overlies the arcuate portion 90 of the nozzle cover 80. Thus, when the dust cup assembly 20 is mounted to the floor nozzle 22, the nozzle top cover 80 cannot be removed. Therefore, access cannot be had to the rotatable brush 72 or the belt 70 for removal or changing thereof.

However, when the dust cup assembly 20 is in a horizontal position, as specifically illustrated in FIG. 2, the base end 94 does not overlie the arcuate portion 90. However, a body edge 96 of the base portion overlies the projections 92 to prevent removal of the nozzle cover 80.

With reference to FIGS. 3–7, the sequence of obtaining access to the nozzle components is illustrated.

Initially, and with reference to FIG. 3, the lamp cover 78 must be moved pivotally upward with respect to the nozzle cover 80 so that the user can grasp and remove a head lamp 98. Specifically, the top assembly 76 cannot be removed with the head lamp 98 in place. Subsequently, and with reference to FIG. 4, the dust cup 58 is removed from the dust cup assembly 20 by disengaging a locking element 100 and removing the dust cup 58. Removal of the dust cup 58 provides access to the swivel coupler tabs 86, see FIG. 1, which extend outwardly through the dust cup assembly openings 60.

The user depresses the tabs, as indicated by the arrows, so that the dust cup assembly 20 can be removed from the swivel coupler 82.

With the dust cup assembly 20 removed, there is no restriction on removal of the nozzle cover 80. Therefore, a user can grasp locking tabs 102 provided on either side of the nozzle cover 80 which lock the nozzle cover 80 to the base 66. Thereafter, the nozzle cover assembly 76 is moved pivotally forwardly, as illustrated by the arrow. Resultantly, and as illustrated in FIG. 7, access is had to the motor 68, the brush 72 and the belt 74 for removal or cleaning, as necessary, or desired.

As discussed above, removal of the dust cup assembly 20 from the floor nozzle 22 results in disconnection of the dust cup assembly socket 64 from the nozzle plug 88. Therefore, even if power is applied to the canister 12, or the handle 16, as discussed above, there is no connection to the floor nozzle 22. Resultantly, the motor cannot be energized, and there is no chance for shock since there is no power whatsoever owing to the positive disconnection of power to the floor nozzle 22.

Figure 8:
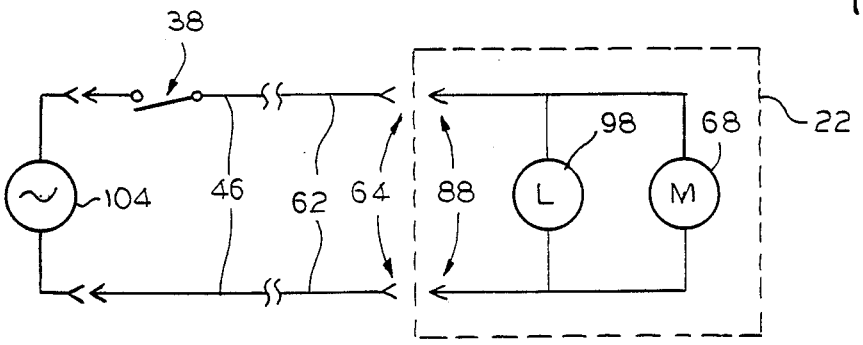
FIG. 8 is an electrical schematic for handle assembly and floor nozzle components.

With reference to FIG. 8, a schematic diagram generally illustrates power connection to the floor nozzle 22. Specifically, the motor 68 and lamp 98 are connected to the plug 88. The dust cup assembly socket 64 is connected through the conductors 62 and then the cord 46 to the on/off switch 38 and through suitable connection to a source of power 104. As is evident, when the plug 88 is removed from the socket 64 there is no power connection to the floor nozzle 22.

Thus, in accordance with the above-described invention, a safety interlock device for a vacuum floor nozzle 22 permits user access to floor nozzle components while preventing the user from being shocked or injured due to user contact with exposed or moving components. Additionally, the invention provides a reliable safety interlock device at minimum expense for parts and assembly. Moreover, a safety interlock device is provided which is easy to use, yet discourages tampering and attempts to defeat it.

I claim:

1. In a vacuum cleaner including a handle and a floor engaging portion coupled to said handle and having a base mounting an electric motor and a rotatable brush driven by said motor, and a cover removably mounted to said base and overlying said motor and brush, and a plurality of electrical conductors connectable to a source of power and extending from said handle to said motor, the improvement comprising:

means operatively associated with said floor engaging portion for disconnecting said motor from the source of power prerequisite to removing said cover from said base.

2. The improvement of claim 1 wherein said disconnecting means comprises a plug and socket.

3. The improvement of claim 1 wherein said disconnecting means comprises means for preventing removal of said cover unless said handle is uncoupled from said floor engaging portion.

4. The improvement of claim 1 wherein said disconnecting means comprises a removable wand disposed between said handle and said floor engaging portion.

5. A vacuum cleaner comprising:

a floor engaging portion including a motor, a rotatable brush driven by said motor, and a removable cover overlying said motor and said rotatable brush;

a selectively disengagable handle body supported by said floor engaging portion;

a first plurality of electrical conductors carried by said handle body including means for connecting said conductors to a source of electrical power;

a second plurality of electrical conductors located in said floor engaging portion selectively connected to said motor;

connector means for connecting said first plurality of conductors to said second plurality of conductors incident to said handle body being supported by said floor engaging portion; and means for preventing removal of said cover unless said handle body is disconnected from said floor engaging portion.

6. The vacuum cleaner of claim 5 wherein said connector means comprises a plug and socket.

7. The vacuum cleaner of claim 6 wherein said plug and socket are rigidly secured within said floor engaging portion and said handle body, respectively.

8. The vacuum cleaner of claim 5 wherein said preventing means comprises means integral with said cover for abutting said handle body incident to attempted removal of said cover if said handle body is connected to said floor engaging portion.

9. The vacuum cleaner of claim 5 further comprising a removable belt interconnecting said motor and said brush and wherein said preventing means prevents removal of said belt unless said first plurality of conductors is disconnected from said second plurality of conductors.

10. The vacuum cleaner of claim 5 wherein said brush is a removable brush and wherein said preventing means prevents removal of said brush unless said first plurality of conductors is disconnected from said second plurality of conductors.

11. In a vacuum cleaner having a wheeled nozzle housing an electric motor for driving a rotatable brush, and a handle assembly for providing suction to the nozzle and power to the motor, a safety interlock comprising:

a removable cover supported on said nozzle in overlying relation with said motor and brush;

a swivel coupler pivotally mounted to said nozzle and including a first electrical connector connected to said motor;

a fixed coupler mounted to said handle assembly couplable with said swivel coupler and including a second electrical connector, connected to a plurality of electrical conductors for providing power, connectable to said first electrical connector incident to said couplers being selectively coupled; and means for preventing removal of said cover unless said first connector is disconnected from said second connector.

12. The safety interlock of claim 11 wherein said connectors comprises a plug and socket.

13. The safety interlock of claim 12 wherein said plug and socket are rigidly secured to said swivel coupler and said fixed coupler, respectively.

14. The safety interlock of claim 11 wherein said preventing means comprises means integral with said cover for abutting said handle assembly incident to attempted removal of said cover if said handle assembly is connected to said nozzle.

15. The safety interlock of claim 11 wherein said vacuum cleaner further comprises a removable belt interconnecting said motor and said brush and wherein said preventing means prevents removal of said belt unless said first connector is disconnected from said second connector.

16. The vacuum cleaner of claim 11 wherein said brush is a removable brush and wherein said preventing means prevents removal of said brush unless said first connector is disconnected from said second connector.

* * * * *